US007559553B2

(12) United States Patent
LaPorte et al.

(10) Patent No.: US 7,559,553 B2
(45) Date of Patent: Jul. 14, 2009

(54) DUAL PLAY AREA LOTTERY GAME WITH ENHANCED AUTHENTICATION SYSTEM

(75) Inventors: René LaPorte, Repentigny (CA); Benoit Mirandette, Lachenaie (CA)

(73) Assignee: Oberthur Gaming Technologies, Inc., Montreal, Quebec (CA)

( * ) Notice: Subject to any disclaimer, the term of this patent is extended or adjusted under 35 U.S.C. 154(b) by 359 days.

(21) Appl. No.: 11/480,699

(22) Filed: Jul. 3, 2006

(65) Prior Publication Data

US 2006/0249898 A1 Nov. 9, 2006

Related U.S. Application Data

(63) Continuation of application No. 10/845,004, filed on May 13, 2004, now Pat. No. 7,125,017.

(60) Provisional application No. 60/471,786, filed on May 20, 2003.

(51) Int. Cl.
*A63F 3/06* (2006.01)

(52) U.S. Cl. ..... 273/139; 283/901; 283/903

(58) Field of Classification Search ..... 273/139, 273/269; 283/901, 903, 72, 94, 111
See application file for complete search history.

(56) References Cited

U.S. PATENT DOCUMENTS

| | | | |
|---|---|---|---|
| 5,562,284 | A | 10/1996 | Stevens |
| 6,234,477 | B1 | 5/2001 | Scrymgeour et al. |
| 6,270,406 | B1 | 8/2001 | Sultan |
| 6,736,324 | B2 | 5/2004 | Behm et al. |

FOREIGN PATENT DOCUMENTS

| | | |
|---|---|---|
| WO | WO 00/05080 | 3/2000 |

*Primary Examiner*—Benjamin H Layno
(74) *Attorney, Agent, or Firm*—Dority & Manning, P.A.

(57) ABSTRACT

A lottery ticket including at least one first play area and at least one second play area in which authenticating indicia is printed beneath the scratch-off layer in the second play area and on top of the scratch-off layer in the second play area. If the player decides not to play the second play area, the authenticating indicia on top of the scratch-off layer in the second play area authenticates the lottery ticket and the prize that is won. If the second play area is played, then the authenticating indicia printed below the scratch-off layer is employed as the authenticating indicia.

21 Claims, 4 Drawing Sheets

DUAL PLAY AREA LOTTERY GAME WITH ENHANCED AUTHENTICATION SYSTEM

This application is a continuation of patent application Ser. No. 10/845,004 filed May 13, 2004, now U.S. Pat. No. 7,125,017, which claims the benefit of 60/471,786 filed May 20, 2003.

FIELD OF THE INVENTION

The present invention is generally directed to a lottery ticket which provides an authentication system for authenticating/validating a lottery ticket game employing a dual play area wherein one of the play areas is employed by the player to optionally risk a winning prize obtained in at least one other play area with the hope that the prize may be enhanced. The present invention employs authentication indicia in the second play area both beneath and on top of a scratch-off layer.

BACKGROUND OF THE INVENTION

Lottery tickets of the scratch-off variety are well known and played by a significant number of players in the United States and in other countries of the world. Scratch-off games typically have the player remove a scratch-off layer from a designated play area to expose multiple indicia in which certain patterns of the play indicia or game symbols, if present, constitute a winning prize.

There has been a growing tendency to introduce scratch-off lottery tickets in which the type of game or play action involves more than merely removing a scratch-off layer to ultimately determine if a prize has been won. The object is to provide the player with an additional form of amusement.

One such lottery ticket is a scratch-off lottery ticket with a first play area as is customary with lottery tickets. Play indicia are provided beneath the scratch-off layer and if removal of the scratch-off layer of all or part of the game area in accordance with the instructions of the lottery game reveals a prize winning combination, then the player may win a prize. Such lottery tickets also include a second play area in which the player may optionally risk the prize that is won in the first play area by removing the scratch-off layer from the second play area. If a prize enhancing symbol is present, then the value of a prize won in the first play area will be enhanced. On the other hand, if a prize reducing symbol is present, the value of the prize may be decreased or even eliminated.

While the attractiveness of a lottery ticket game to the purchasing public depends in part on the prize structure and the type of game being played, the success of the lottery system also depends on the ability of lottery sponsors to provide sufficient protection against counterfeiting and the like of lottery tickets (i.e. the ability to authenticate/validate that a ticket presented for claiming a prize is a proper ticket and the prizes claimed on the ticket are also proper).

In dual play area type lottery tickets described above, there is a concern that unscrupulous retail agents may manipulate the lottery system by fraudulent claiming of winning tickets. For example, the lottery ticket agent may perpetuate fraud on winning tickets in which a prize has been awarded in the first play area and the player has opted not to play the second play area. The retail agent may pay off the prize designated in the first play area and then remove the scratch-off layer in the second play area to see if a prize enhancing symbol is present. If so, the retail agent proceeds to collect the enhanced prize from the lottery sponsor. If the lottery sponsor requires the retail agent to turn in all tickets, then the retail agent will need to look below the scratch-off layer (e.g. by pinholing) to observe whether a prize enhancing symbol is present before removing the scratch-off layer.

In this type of lottery ticket, each of the first play area and the second play area are provided with identical authentication indicia which if read by an optical scanner can authenticate the ticket. However, the presence of the same indicia in the first and second play areas enables an unscrupulous retail agent to circumvent the system and obtain the benefit associated with tickets collected in which the player has not played the second play area and the second play area contains a prize enhancing symbol. This is because in part, the optical scanner does not effectively differentiate between lottery tickets in which only the first play area was played and lottery tickets in which both the first and second play areas were played.

It would therefore be a significant advance in the art of protecting such dual play area lottery game tickets from counterfeiting or misplaying if enhanced security can be provided in connection with the second play area.

It would be a further significant advance in the art if an authentication/validation system could be developed in which authentication/validation of a properly played second play area negates authentication/validation of the same ticket for the first play area.

SUMMARY OF THE INVENTION

The present invention is generally directed to a lottery ticket having at least one first play area which when played determines if a prize has been won, and a second play area which may be optionally played by the player with the hope of enhancing the value of the prize won in the first play area at the risk of possibly losing some to all of the value of such prize. The present invention provides for authentication indicia both below the scratch-off layer and above the scratch-off layer in the second play area so that reading of the authentication indicia on top of the scratch-off layer authenticates/validates the ticket for the playing of the first play area in the absence of playing the second play area, while reading the authenticating indicia beneath the scratch-off layer authenticates/validates the ticket only for having played both the first and second play areas.

As used herein the terms "authenticate" and "validate" are intended as alternative expressions each referring to a process or system by which a lottery ticket is determined to be a properly issued ticket of the lottery sponsor and that any prize which is set forth on the ticket by the playing of the lottery ticket game may properly be awarded. Hereinafter, for the sake of convenience, the application will employ the term "authenticate" or related term.

In one aspect of the present invention, there is provided a lottery ticket comprising:

a) a substrate;

b) at least one first play area covering at least a portion of the substrate and comprising at least one game indicia;

c) a first scratch-off layer covering the at least one first game indicia wherein the removal of the scratch-off layer to reveal up to all of the game indicia may result in a prize being won;

d) a second play area comprising at least one prize affecting indicia and a first ticket authenticating indicia;

e) a second scratch-off layer covering the at least one prize affecting indicia and the first ticket authenticating indicia; and f) a second ticket authenticating indicia printed on top of the second scratch-off layer.

In another aspect of the present invention there is provided a method of authenticating a lottery ticket of the type described above in which the method comprises reading the second ticket authenticating indicia as indicative of the player playing only the first play area or reading the first ticket authenticating indicia as indicative of the player having removed the scratch-off layer from the second play area and thereby having played the optional second play area. The second ticket authenticating indicia or the first ticket authenticating indicia are verified or matched with information contained in a database and if there is a match the ticket and the amount of the prize are therefore authenticated.

BRIEF DESCRIPTION OF THE DRAWINGS

The following drawings in which like reference characters indicate like parts are illustrative of embodiments of the invention and are not intended to limit the invention as encompassed by the full disclosure of the application including the claims.

DETAILED DESCRIPTION OF THE INVENTION

The present invention is generally directed to a lottery ticket of the type employing a first play area where a conventional lottery game may be played and a second play area which offers the player the opportunity to increase the value of the prize in the first play area while at the same time running the risk that the value of the prize uncovered in the first play area may be unaffected, reduced or even lost. The present invention is particularly directed to a method of authenticating such tickets while preventing unscrupulous lottery players including retail agents from misusing the lottery tickets such as by determining in advance without detection, whether the second play area contains a prize enhancing symbol.

Figure 1:
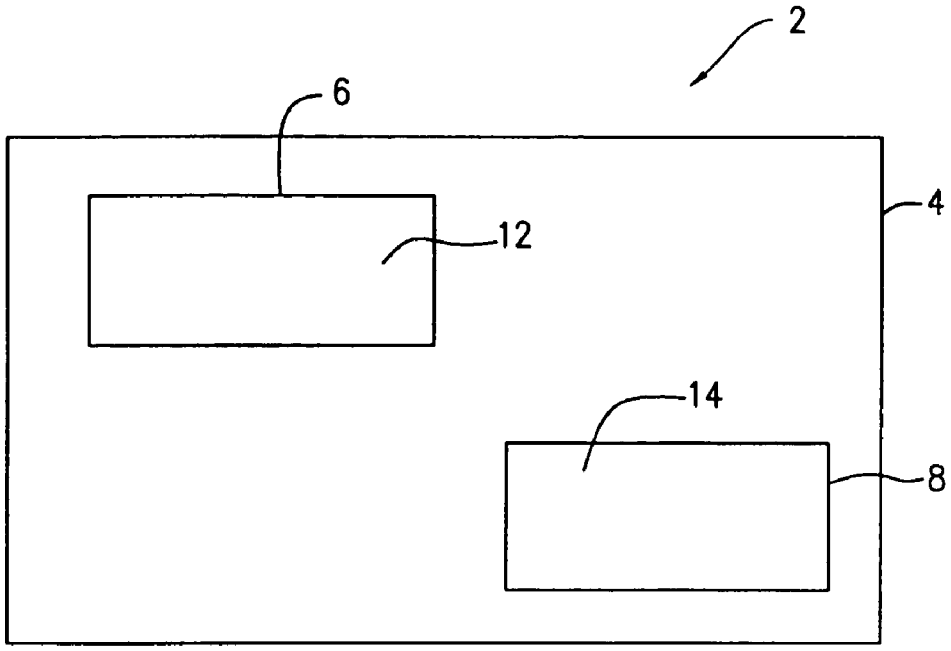
(PRIOR ART) FIG. 1
FIG. 1 is a top view of a prior art lottery ticket employing a first play area and a second play area which contains a prize affecting symbol.
Figure 2:
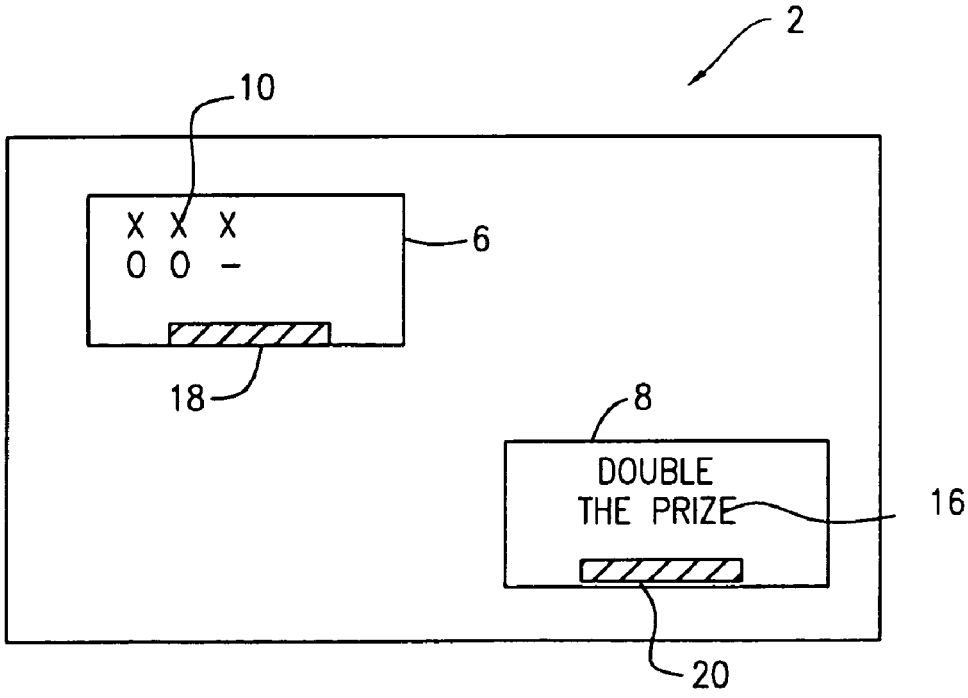
(PRIOR ART) FIG. 2
FIG. 2 is a top view of the prior art lottery ticket shown in FIG. 1 with the scratch-off layer removed from both the first play area and the second play area.

Prior art tickets are known to have a first play area and an optional second play area in which the value of the prize in the first play area may be enhanced at some risk to the player. Referring to FIG. 1, there is shown a prior art lottery ticket 2 having a substrate 4 having printed thereon a first play area 6 and a second play area 8. The first play area 6 contains game indicia 10 as shown in FIG. 2 covered by a scratch-off layer 12. Removal of the scratch-off layer 12 reveals the game indicia 10 and the presence or absence of certain patterns of game indicia 10 (e.g. three of the same symbol) determines whether a prize has been won.

For purposes of illustration only, the game indicia 10 shows the presence of three "X's" which is indicative of a prize being won, the amount of which can appear on the face of the lottery ticket in the form of a prize determining area (not shown) in a conventional manner. It will be understood that the games appearing in the first play area 6 may include probability type games in which the player has a choice in selecting a predetermined number of play regions from a larger set of play regions comprising the first play area. In addition, embodiments of the present invention facilitate the playing of casino type games such as blackjack, poker and the like.

The second play area 8 is an optional play area as described below and contains prize affecting indicia 16 covered by a scratch-off layer 14 which can be in the form of a prize enhancing indicia as specifically shown in FIG. 2, a prize reducing indicia including the entire elimination of the prize and a "no change" form of indicia in which the value of the prize does not actually change but the player is allowed to keep the original value of the prize won in the first play area. Thus, if the player wins a prize from playing the game in the first play area, the player must decide whether to risk the value of that prize by playing the second play area whereby the value of the prize may increase, decrease, be eliminated or not changed.

Conventional prior art lottery tickets of the type described in connection with FIGS. 1 and 2 have been authenticated by providing both the first play area 6 and the second play area 8 with authenticating indicia placed beneath the scratch-off layer.

Referring to FIG. 2, after removal of the respective scratch-off layers 12, 14 from the first play area 6 and the second play area 8 (see FIG. 1), there is shown a first play area authenticating indicia 18 and a second play area authenticating indicia 20. The respective first and second play area authenticating indicia 18, 20 in accordance with the prior art tickets are a series of numbers and letters which can be manually entered into or scanned into a suitable lottery ticket reading apparatus which is operatively connected to a lottery sponsor database of lottery tickets. A comparison of the entered information with the database determines if the first and second authenticating indicia 18, 20 match each other and find correspondence in a lottery ticket sponsored database. If this criteria is met, the lottery ticket is authenticated and a prize may be awarded.

A significant problem with such prior art lottery tickets is that they do not effectively prevent an unscrupulous lottery player (e.g. retail agent) from improperly collecting on tickets which contain a prize enhancing symbol in the second play area. By way of example, a lottery player plays the first play area and wins a prize (e.g. $10). He or she presents the played lottery ticket in which the player has played the first play area but has decided not to risk the prize by playing the second play area to a lottery ticket agent for authentication and collection of the prize. The lottery ticket agent can then pay the $10 winning prize to the player and then determine if there is a prize enhancing symbol in the unplayed second play area which remains covered by a scratch-off layer. If there is a prize enhancing symbol in the second play area, the lottery ticket agent can then remove the scratch-off layer from the second play area and enter the authentication indicia under the scratch-off layer in the second play area into the lottery ticket authenticating apparatus. The lottery ticket agent can then claim the higher value prize thereby netting a profit comprised of the difference between the higher value prize and the prize which was originally paid out to the lottery player. Thus, the retail agent visually picks which authentication indicia should be entered into the lottery ticket authenticating apparatus. Because the first authenticating indicia and the second authenticating indicia are the same and because there is no machine which automatically reads the authenticating indicia, the retail agent can carry out the unscrupulous enterprise identified above without detection.

In accordance with the present invention, there is provided a lottery ticket of the type described above which contains an authenticating system providing an additional measure of protection to dual play area lottery tickets which prevents and/or deters the kind of unscrupulous activity described above.

Figure 3:
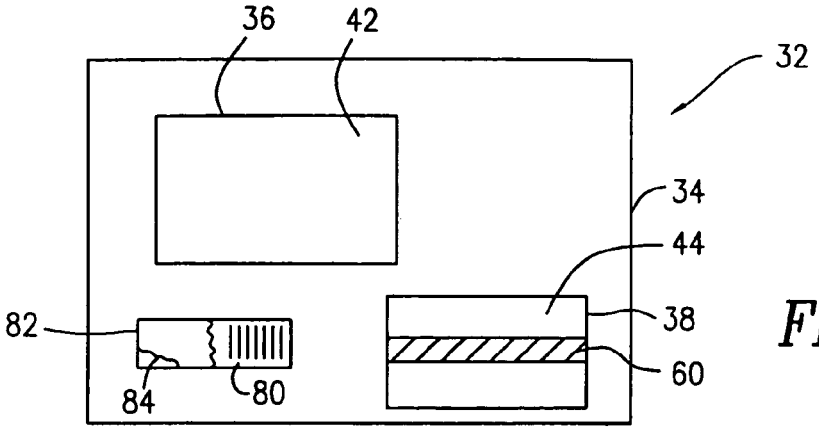
FIG. 3 is a top view of a first embodiment of a lottery ticket in accordance with the present invention.
Figure 4:
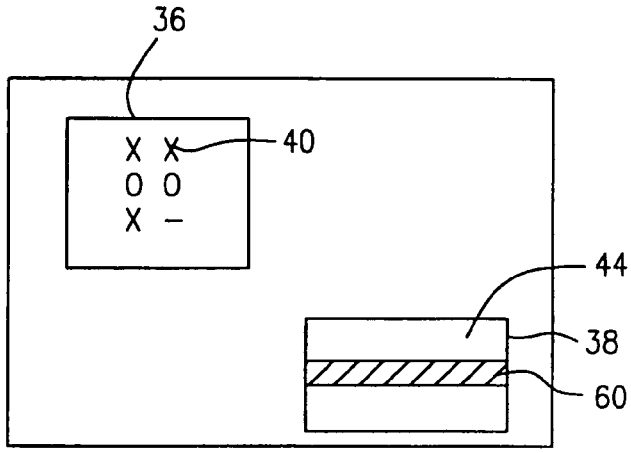
FIG. 4 is a top view of the lottery ticket shown in FIG. 3 with the scratch-off layer removed from the first play area.
Figure 5:
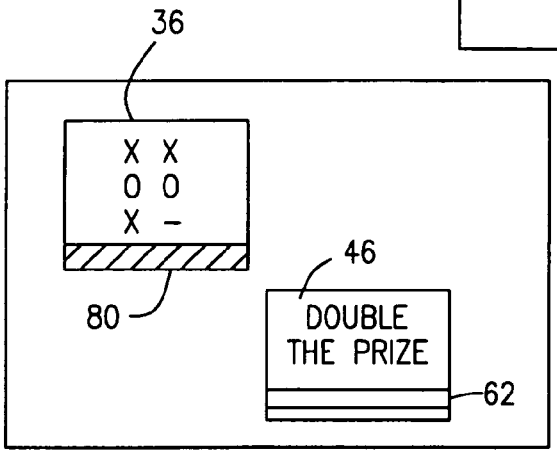
FIG. 5 is a top view of the lottery ticket shown in FIG. 3 with the scratch-off layer removed from both the first play area and the second play area.

Referring to FIGS. 3-5, there is disclosed a lottery ticket of the present invention identified by the numeral 32. As with the prior art ticket shown in FIGS. 1 and 2, the present lottery ticket has a substrate 34 having imprinted thereon a first play area 36 and a second play area 38 each covered by respective scratch-off layers 42 and 44.

Beneath the scratch-off layer 42 of the first play area 36 are game indicia 40 for playing the conventional lottery game as shown best in FIGS. 4 and 5 which may include probability type lottery games. Unlike the lottery ticket of the prior art, and specifically as shown in FIGS. 3 and 4, there is provided on top of the scratch-off layer 44 a top side authenticating indicia 60 which may be any type of indicia capable of being used to authenticate a lottery ticket including indicia such as a bar code that can be read by a lottery ticket authenticating apparatus. As shown in FIG. 5, beneath the scratch-off layer 44 covering the second play area 38 there is provided a bottom side authenticating indicia 62 which is also capable of being used to authenticate a lottery ticket. However, the top side authenticating indicia 60 will be comprised of different symbols than the bottom side authenticating indicia 62 so that the authenticating indicia 60 and 62 can be differentiated. The bottom side authenticating indicia 62 likewise is preferably read by a lottery ticket authenticating apparatus. Of particular importance to the present invention, is the fact that the bottom side authenticating indicia 62 is a different series of symbols than the top side authenticating indicia as described hereinafter.

The second play area 38 also includes prize affecting indicia 46 beneath the scratch-off layer 44 which may, but need not, have an effect on the value of the prize which may be won in the first play area as previously described (i.e. may raise the value of the prize, lower the value of the prize, eliminate the value of the prize or not change the value of the prize).

In accordance with the present invention and referring to FIGS. 3-5, the player plays the game in the first play area 36 in a conventional way and if a prize has been won as shown in FIGS. 4 and 5 (e.g. three matching "X's") then the player has the option of playing the second play area 38. If the player does not opt to play the second play area, the player brings the lottery ticket to the retail lottery agent for collection of the prize. In order to make a match with the lottery sponsor database of authenticating information, the lottery retail agent must associate the lottery ticket with the lottery ticket authenticating apparatus which reads the authenticating indicia 60 appearing on top of the unscratched second play area 38. The reading of the authenticating indicia 60 not only identifies the lottery ticket as a proper lottery ticket but also identifies the lottery ticket as one where only the first play area has been played and not the second play area and that any prize that may be awarded must be awarded based on playing the first play area only.

If the second play area is played by the player, the removal of the scratch-off layer 44 will reveal a prize affecting symbol 46 and the authenticating indicia 62. At the same time the authenticating indicia 60 will be removed because it appeared on the scratch-off layer 44. If the player is to collect the prize, the lottery ticket agent must enter the ticket into the lottery ticket authenticating apparatus. It is the lottery ticket authentication apparatus which reads the authenticating indicia 62. Since the authenticating indicia 62 is sufficiently different than the authenticating indicia 60 to be differentiated by the lottery ticket authenticating apparatus, it serves two functions. First, it provides a match with the lottery ticket database to indicate that it is a proper ticket. Second, and of particular importance to the present invention, the presence of authenticating indicia 62 identifies the ticket as one in which the second play area has been played and therefore will only authenticate a prize based on the playing of both the first play area and the second play area. Thus, as can be seen, the lottery ticket of the present invention through the authentication system described above locks in the lottery ticket after the first play area has been played and the ticket presented for collection so that unscrupulous playing of the second play area without authorization cannot take place because the lottery ticket has been tagged a first play area only lottery ticket by the reading of the authenticating indicia 60. Similarly, if the second play area has been played, the reading of the authenticating indicia 62 locks in the lottery ticket as a second play area only ticket.

Figure 6:
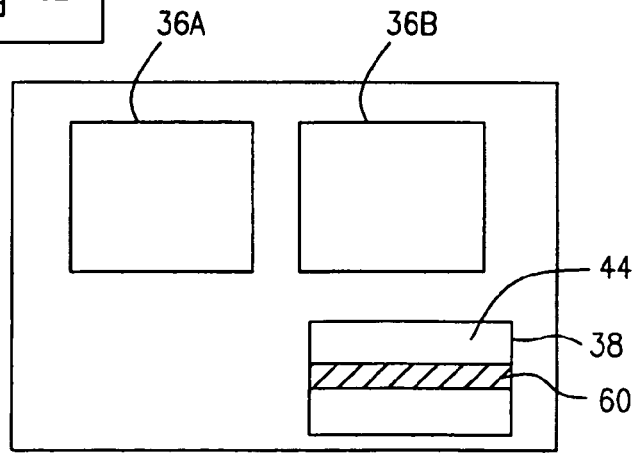
FIG. 6 is a further embodiment of the present invention showing the employment of two first play areas.

Other embodiments of the present invention would be apparent to those of ordinary skill in the art and one such embodiment is shown in FIG. 6 in which two first play areas 36A and 36B are shown. The lottery ticket can be played in the same way with the option of playing the second play area as described above.

In accordance with a preferred embodiment of the present invention, the authenticating indicia 60 and 62 are in the form of a bar code. Bar codes are comprised of patterns of bars and spaces used to represent different characters. Sets of these patterns are grouped together to form symbiology. Over the years there have been developed different types of bar codes which are identified by such designations as code 39, code 93, code 128, PDF 417, interleave 205, etc. In a preferred form of the present invention, the bar code (e.g. PDF) contains all of the information necessary for authenticating the lottery ticket. Thus, either or both of the authenticating indicia 60 and 62 can be in the form of a bar code which contains all information for authenticating the lottery ticket.

Bar codes which do not contain all information for authenticating a lottery ticket may be employed and under these circumstances, it may be necessary to employ another third authenticating indicia which can be in the form of a series of numbers and/or letters (e.g. pin number) which may be manually entered into the lottery ticket authenticating apparatus by the lottery ticket retail agent. As shown in FIG. 3, the third authenticating indicia 80 may appear in a separate region 82 covered by a separate scratch-off layer 84 or may appear in, for example, the first play area 36 as shown in FIG. 5 and thereby covered by the same scratch-off layer 42 continuously covering the entire first play area 36.

When the authenticating indicia is in the form of a bar code, the printing of the bar code beneath the scratch-off layer (i.e. authenticating indicia 62) takes advantage of the technology described in U.S. Pat. No. 6,308,991, incorporated herein by reference.

Figure 7A:
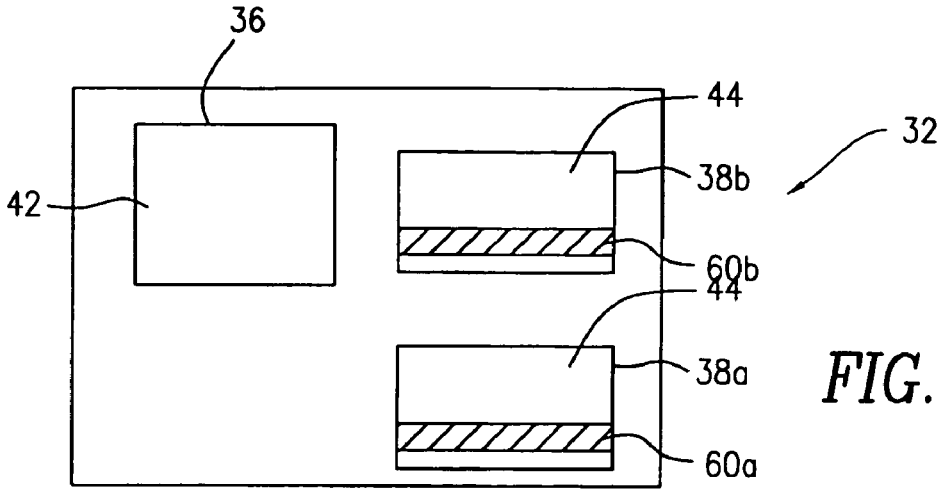
FIG. 7A-7C are top views of another embodiment of the present invention showing two second play areas.
Figure 7B:
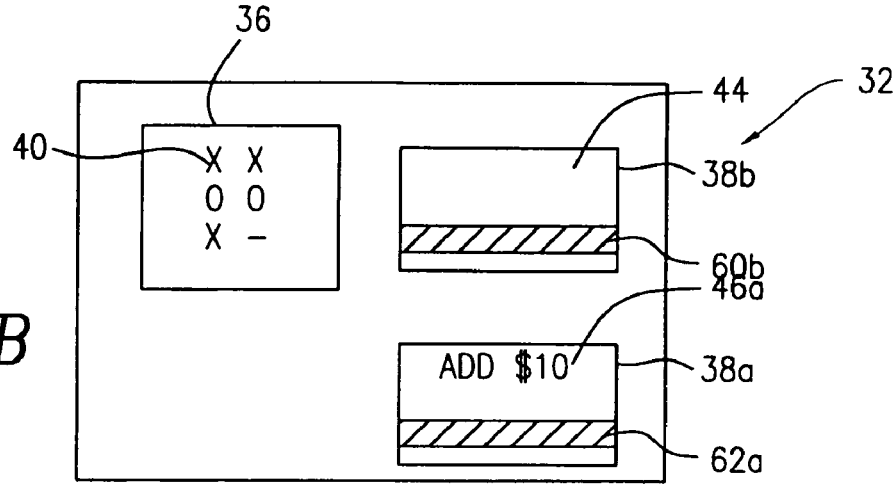
Figure 7C:
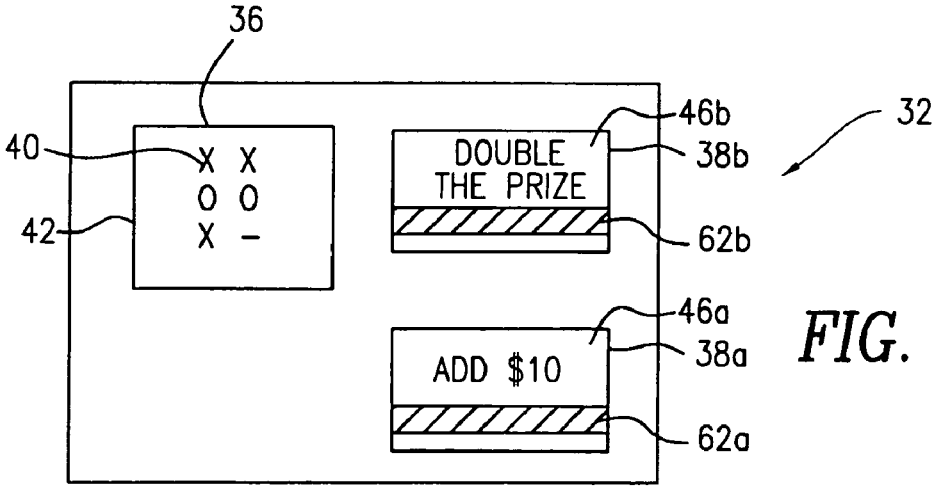

In a further embodiment of the invention, there is provided at least two second play areas which enable the player to risk what has already been won at least two times. Referring to FIGS. 7A-7C, there is shown a lottery ticket 32 having one first play area 36 covered by a scratch-off layer 42 and two second play areas 38A and 38B each covered by a scratch-off layer 44. As with the embodiments of the invention described in connection with FIGS. 3-6, the two second play areas 38A and 38B each have authentication indicia 60A and 60B which will be read by a lottery ticket authentication apparatus if neither of the two second play areas is played by the player of the lottery ticket.

As shown in FIGS. 7B and 7C, it is possible to play one or both of the second play areas if the player so chooses. As shown in FIG. 7B, the one second play area 38A has been played and an additional prize as represented by the play indicia 46A has been won. In this event, the authentication indicia 60A is removed because the scratch-off layer 44 is removed to reveal the play indicia 46A and the authentication indicia 62A now appears. If the player plays only the one second play area 38A, then the lottery ticket authentication apparatus will read the authentication indicia 62A and 60B indicating that the one second play area 38A has been played while the other second play area 38B has not.

As shown in FIG. 7C, if both second play areas 38A and 38B are played then the authentication indicia 62A and 62B will be read by the lottery ticket authenticating apparatus to authenticate the lottery ticket as one having both second play areas 38A and 38B played by the player.

Figure 8:
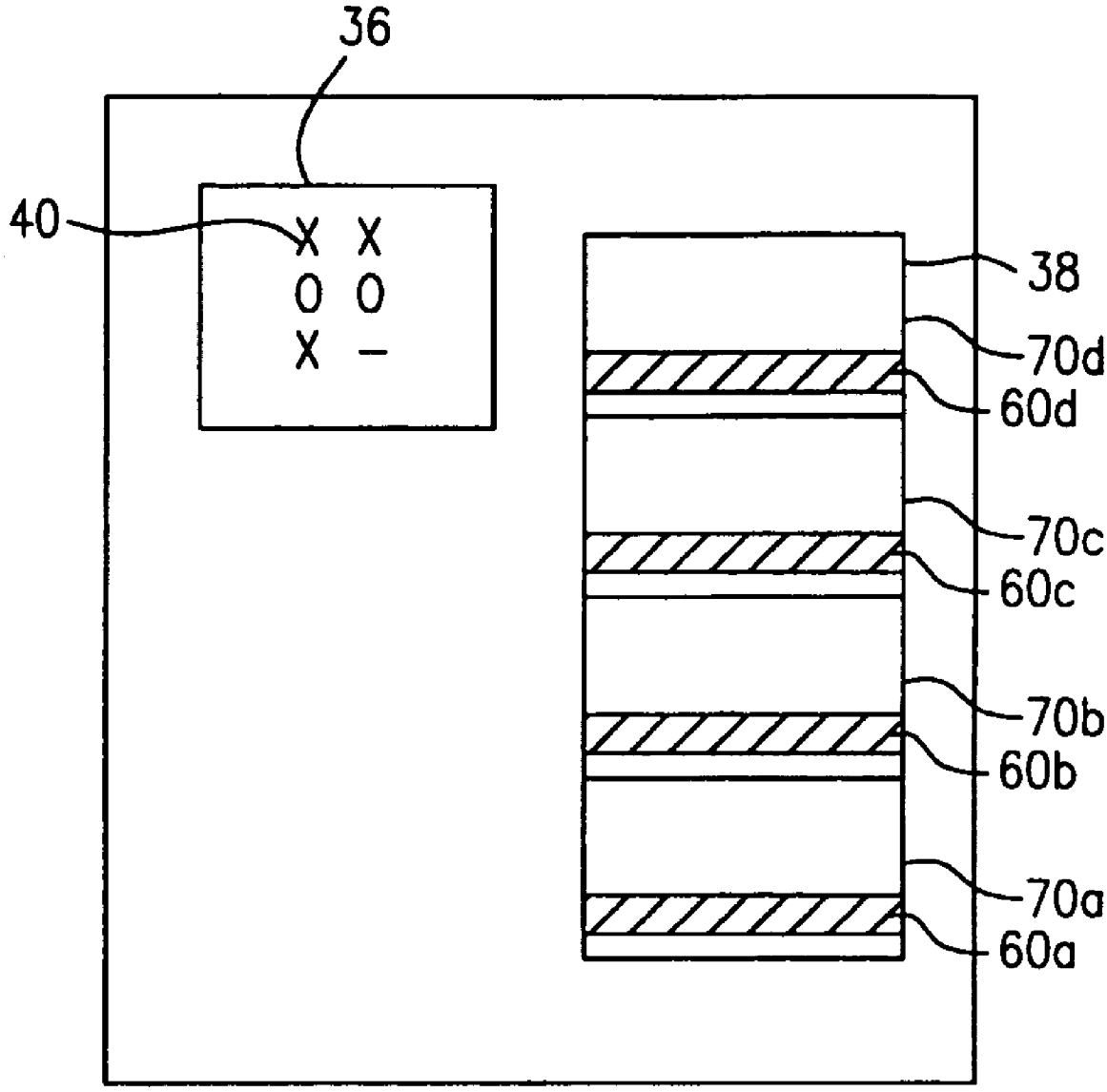
FIG. 8 is a top view of a still further embodiment of the present invention showing a second play area with multiple second play regions.

It will be understood that two or more second play areas may appear on a lottery ticket within the spirit and scope of the present invention. It should also be noted that it is within the scope of the present invention to employ a single first play area which has multiple second play area regions as shown specifically in FIG. 8. Referring to FIG. 8, there is shown a second play area 38 having, for example, four second play regions 70A-70D each of which contains a prize affecting symbol as previously described.

It will be understood that if there are multiple second play areas or multiple second play regions, the lottery ticket may instruct the player on the order in which the second play areas or second play regions may be played. For example, in the lottery ticket shown in FIGS. 7A-7C, the lottery ticket may provide instructions requiring the player, if a second play area is to be played, to first play the one second play area 38A followed by the other second play area 38B, etc. Alternatively, the lottery ticket may provide instructions that the player is free to choose any one or more second play areas or second play regions in any order to bring probability elements into the risk portion of the lottery ticket.

By way of illustration, the lottery ticket shown in FIG. 8 may provide instructions stating that if the player is to play a second play region identified by the numeral 70A-70D, he or she must do so in order (i.e. play region 70A must be played first followed by region 70B, etc.). Alternatively, the lottery ticket may provide for the player to select any one of the optional second play regions 70A-70D at his or her discretion and to proceed at his or her option to select any order for playing the second play regions.

When the lottery ticket is read by a lottery ticket authenticating apparatus, the optical scanner will read the authenticating indicia 60A-D as indicative that none of the four second play regions 70A-70D has been played. If one or more these regions has been played, then as previously described in connection with FIGS. 7A-7C, authentication indicia 62 (e.g. 62A) will appear being indicative of the playing of the second play region 70A or any of the other second play regions 70B-70D shown in FIG. 8.

In a further and optional aspect of the present invention, there may be provided a means for preventing a copy of the second ticket authenticating indicia from being read by a lottery ticket authenticating apparatus as an original second authenticating indicia.

In a further way of preventing fraud and counterfeiting in connection with the lottery tickets described herein, an optional embodiment of the present invention is designed to protect a lottery ticket agent from duplicating the second ticket authenticating indicia identified in FIG. 3 by the numeral 60. This further aspect of the present invention can prevent fraud in accordance with the following.

As previously explained, a lottery ticket agent can collect lottery tickets in which the player has decided not to play the second play area. Such lottery tickets will have the appearance as shown in FIG. 4. These lottery tickets are turned into the lottery ticket agent by the player because the player has won a prize in the first play area but has chosen not to risk that prize by playing the second play area.

The lottery ticket agent will pay the player the value of the first play area prize (e.g. $10). Before entering the ticket into the lottery ticket authenticating apparatus so that it can read the second ticket authenticating indicia, the lottery agent makes a copy of the second ticket authenticating indicia and then removes the scratch-off layer containing the same. If the second play area shows an increased value prize, the lottery ticket agent, as previously explained, then enters the lottery ticket into the lottery ticket authenticating apparatus to read the first ticket authenticating indicia thereby claiming a higher value prize (e.g. $20) and pocketing the difference between the higher valued prize and the amount that the lottery ticket agent has paid to the player for the prize awarded in the first play area. On the other hand, if the second play area results in a decrease or elimination of the value of the prize from the first play area, the lottery ticket agent then takes a copy of the second ticket authenticating indicia, places it over the first ticket authenticating indicia and then places the lottery ticket in that condition into the lottery ticket authenticating apparatus. As a result, the lottery ticket authenticating apparatus reads the copy of the second ticket authenticating indicia which is recorded as a ticket in which only the first area has been played. This scheme will enable the lottery ticket agent to go undetected and to collect on all lottery tickets in which the player has played only the first play area and the second play area results in an increase in the value of the prize.

The following embodiments of the present invention are directed to solving this problem. In general, the embodiments which are described below prevent a copy of the second authenticating indicia from being read by a lottery ticket authenticating apparatus as if it were an original. In a first embodiment of this aspect of the invention, a coating layer is placed over and/or under the second ticket authenticating indicia which coating layer can prevent duplication of the second ticket authenticating indicia, preferably in its entirety. Thus, the coating layer will contain a substance or printed pattern which when an attempt is made to duplicate the second ticket authenticating indicia blocks out the indicia so that it cannot be read by a lottery ticket authenticating apparatus. As used herein, duplication of the second ticket authenticating indicia shall be by any means with the most common being by camera or by a photocopier. Such substances for incorporation into a coating layer or any substances which when exposed to a duplicating method such as a camera or a photocopier reacts to the same in a manner which at least partially obliterates the second ticket authenticating indicia. Such substances include screens of colors such as magenta, warm red or other red colors, infrared wavelength absorbing substances or inks which appear black to a photocopier or scanner but which are invisible to a bar code scanner. Such inks are used in security printing of documents available from National Printing Bureau of Japan. In addition, photochromic inks may be used which are transparent to visible light but are visible when excited under specific wavelengths of light.

In another embodiment of the invention, the coating layer which is placed over and/or under the second ticket authenticating indicia has a substance wherein a copy of the second ticket authenticating indicia has different spectral characteristics than that of the original. The difference in spectral characteristics will exhibit different reflectance values and will be detectable by the lottery ticket authenticating apparatus. Accordingly, when a copy of the second ticket authenticating indicia is placed into a lottery ticket authenticating apparatus, a difference in spectral characteristics will be detected from the original (which has a predetermined spectral characteristic) and will not therefore be authenticated. Examples of such coating layers include fluorescent coating layers, coating layers containing magnetic particles, and coating layers containing inks which emit in the ultraviolet of infrared spectrum. It should be noted that the key requirement is that the original second ticket authenticating indicia have a predetermined spectral characteristic which is different from that which would be obtained if a copy of the original is made and entered into the lottery ticket authenticating apparatus.

In a further embodiment of the invention, the problem of improper copying of the second ticket authenticating indicia can be overcome by collecting all of the lottery tickets that have been validated and authenticated by the lottery ticket agent, and scanning these tickets at the office of the lottery sponsor in order to compare the authenticating code which has been read at the two locations. The lottery ticket is not authenticated unless both readings are the same.

In a related embodiment, initial information about the ticket and particularly whether the player has played the first play area only or has played the second play area can be obtained directly from the player through the use of communication systems such as the telephone and the global communication network (Internet). In particular, the lottery ticket can provide instructions for the player to call one telephone number if the player only plays the first play area and a second, different telephone number if the player proceeds to play the second play area. The player will then communicate with the lottery sponsor and information would be taken to verify that the ticket is authentic. In addition, the player may be required to deliver the winning ticket to a lottery ticket agent who would then complete the authentication process by inserting the winning lottery ticket into the lottery ticket authenticating apparatus. Fraudulent lottery intervention would be prevented because information about whether the player played the first play area only or the second play area (coming directly from the player) would already be in the lottery sponsor database so that any attempt at fraudulently conveying information by the lottery agent would be detected.

The above-described system can be facilitated through the Internet in essentially the same manner as a telephone based system. The player can enter a lottery sponsor website, insert appropriate information to indicate whether the first play area alone or the second play area has been played, and then the player can be provided with instructions for proceeding to obtain the prize (either by mail) in which case the lottery sponsor can directly scan the ticket in the lottery ticket authenticating apparatus or by proceeding to a lottery ticket agent for collection of the prize and the completion of the authentication process as previously described.

A still further means of preventing fraud in connection with the second ticket authenticating indicia is through a comparison of a theoretical profile of lottery ticket players and the likelihood or frequency in which the players play only the first play area and the frequency in which the players play the second play area. This method would involve generating a database including information pertaining to the frequency that the first game and/or second game area is played to determine a theoretical frequency. A lottery ticket game and all the lottery tickets sold in connection therewith is monitored to determine the frequency (referred to herein as an "actual frequency") in which the first and/or second game area is played. The actual frequency is compared to the theoretical frequency on a continuous basis and if there is more than a predetermined difference between the actual frequency and the theoretical frequency, the lottery sponsor can initiate an investigation as to how the tickets are authenticated at the various lottery ticket agents. In this regard, lottery ticket agents that exhibit a difference between the actual frequency and the theoretical frequency greater than the predetermined difference can be directly monitored and any fraudulent activity can be determined and corrected.

What is claimed is:

1. A lottery ticket comprising:

a) a substrate;

b) at least one first play area covering at least a portion of the substrate and comprising at least one game indicia;

c) a first scratch-off layer covering the at least one first game indicia wherein the removal of the scratch-off layer to reveal up to all of the game indicia may result in a prize being won, the prize having a value;

d) at least one second play area comprising at least one prize affecting indicia and a first ticket authenticating indicia, the prize affecting indicia affecting the amount of the prize value;

e) a second scratch-off layer covering the at least one prize affecting indicia and the first ticket authenticating indicia; and f) a second ticket authenticating indicia printed on the second scratch-off layer.

2. The lottery ticket of claim 1 wherein the first ticket authenticating indicia is used to authenticate the winning of a prize in the first play area.

3. The lottery ticket of claim 1 wherein the prize affecting indicia comprises a prize enhancing symbol which if revealed in the second play area enhances the value of the prize won in the first play area.

4. The lottery ticket of claim 1 wherein the prize affecting indicia comprises a prize reducing symbol which if revealed in the second play area reduces the value of the prize won in the first play area.

5. The lottery ticket of claim 4 wherein the prize reducing symbol cancels the value of the prize won in the first play area.

6. The lottery ticket of claim 1 wherein the prize affecting indicia does not affect the value of the prize won in the first play area.

7. The lottery ticket of claim 1 wherein at least one of the first and second ticket authenticating indicia is a bar code.

8. The lottery ticket of claim 7 wherein the bar code contains all information necessary to authenticate the lottery ticket.

9. The lottery ticket of claim 8 wherein the bar code is a PDF bar code.

10. The lottery ticket of claim 1 wherein both the first and second ticket authenticating indicia are bar codes.

11. The lottery ticket of claim 1 further comprising a third ticket authenticating indicia covered by a scratch-off layer.

12. The lottery ticket of claim 11 wherein the third ticket authenticating indicia is a plurality of numbers.

13. The lottery ticket of claim 11 wherein the scratch-off layer covering the third ticket authenticating indicia is the first scratch-off layer.

14. The lottery ticket of claim 1 comprising at least two second play areas.

15. The lottery ticket of claim 1 comprising at least two second play regions contained within the at least one second play area, each of said second play regions containing at least one prize affecting indicia and the first ticket authenticating indicia.

16. The lottery ticket of claim 1 comprising at least two first play areas.

17. The lottery ticket of claim 1 wherein the player may select any or all of the first play areas.

18. The lottery ticket of claim 1 wherein the game indicia comprise a probability type lottery game.

19. The lottery ticket of claim 1 further comprising means for preventing a copy of the second ticket authenticating indicia from being read by a lottery ticket authenticating apparatus as an original second ticket authenticating indicia.

20. The lottery ticket of claim 19 comprising at least one coating layer placed over or under or both over and under the second ticket authenticating indicia which prevents a copy of the coated second ticket authenticating indicia from being read by the lottery ticket authenticating apparatus.

21. The lottery ticket of claim 19 comprising a coating layer placed over or under or both over and under the second ticket authenticating indicia wherein a copy of the coated second ticket authenticating indicia has different spectral characteristics from the original coated second ticket authenticating indicia.

* * * * *